US006056211A

United States Patent [19]

DiLoreto

[11] Patent Number: 6,056,211

[45] Date of Patent: May 2, 2000

[54] HYDRANT FLUSHING DIFFUSER

[75] Inventor: Rinaldo J. DiLoreto, Chester, Va.

[73] Assignee: Atlantic Construction Fabrics, Inc., Richmond, Va.

[21] Appl. No.: 09/327,530

[22] Filed: Jun. 8, 1999

[51] Int. Cl.[7] ..... B05B 1/28

[52] U.S. Cl. ..... 239/288; 239/462; 239/518; 239/542

[58] Field of Search ..... 239/288, 288.3, 239/288.5, 462, 499, 518, 519, 590.3, 124, 542, DIG. 23

[56] References Cited

U.S. PATENT DOCUMENTS

| | | | |
|---|---|---|---|
| 2,420,958 | 5/1947 | Landreth | 239/542 |
| 2,511,486 | 6/1950 | Thames | 239/542 |
| 2,887,275 | 5/1959 | Dixon, Jr. et al. | 239/462 |
| 3,429,125 | 2/1969 | Shotton | 239/542 |
| 3,430,867 | 3/1969 | Rodgers et al. | 239/542 |
| 3,874,597 | 4/1975 | Stephens et al. | 239/542 |
| 4,475,691 | 10/1984 | Hintz | 239/587 |
| 4,618,420 | 10/1986 | Alanis | 210/169 |
| 4,756,479 | 7/1988 | Lazenby, III | 239/110 |
| 4,944,101 | 7/1990 | Goble | 137/15 |
| 4,970,880 | 11/1990 | Luger | 68/208 |
| 5,360,488 | 11/1994 | Hieatt et al. | 134/22.11 |
| 5,587,072 | 12/1996 | Regan | 210/232 |

*Primary Examiner*—Kevin Weldon
*Assistant Examiner*—Dinh Q. Nguyen
*Attorney, Agent, or Firm*—Millen, White, Zelano & Branigan, P.C.

[57] ABSTRACT

A hydrant flushing diffuser handles a flow of water from a hydrant as it is being flushed. The diffuser allows the flushing to take place in a safe manner and without destroying surrounding landscaping or other objects. The invention includes a hydrant flushing diffuser having a hood and a chute. The hood has a closed top and an open base and includes an aperture. The chute further comprises a porous fabric bag that is open on one end, wherein the chute is connected to the hood so that open end of the bag surrounds the aperture in the hood.

15 Claims, 1 Drawing Sheet

HYDRANT FLUSHING DIFFUSER

This invention relates to a diffuser for handling flow of water from a hydrant as it is being flushed. The diffuser allows the flushing to take place in a safe manner and without destroying surrounding landscaping or other objects.

BACKGROUND OF THE INVENTION

It is a typical practice of state and local water departments to flush water mains and hydrants periodically. The flushing may take place as part of an ordinary maintenance program. Alternatively, a hydrant may be flushed as part of new construction, for instance in a new subdivision, as water pressure and pipes are being prepared for use. Hydrant valves are open to a "full open" position so that maximum fluid flow will be allowed in order to achieve maximum efficiency of the maintenance or installation process.

Fire main hydrants can be mounted in various locations, but, typically, they are positioned along street curbs in areas where access to the hydrant could become necessary. In many instances, these locations are in residential neighborhoods.

Because of the construction of fire main hydrants, when they are flushed they typically produce a water discharge having high energy and exerting significant force upon any object which might come into its path. Typically, the water flow generated during hydrant flushing is in a fixed direction, the direction of discharge not being able to be varied. As can be seen, therefore, hydrant flushing can pose a substantial safety problem. This is especially true in view of the frequent presence of such hydrants in residential neighborhoods where children can be found. It is not unrealistic to expect that injuries could readily occur as a result of the flushing of a hydrant. As a result, hydrant flushing typically requires the blocking of traffic and the presence of monitors to protect vehicles and pedestrians.

In addition to this potential personal injury, the high pressure, high flow of water from a hydrant can cause substantial environmental damage to landscaping around a hydrant. Consequently, washout erosion damage can result. Further, water line sediment built up in the water system may cause further pollution or unsightliness.

SUMMARY OF THE INVENTION

Accordingly, it is an object of the present invention to overcome the foregoing drawbacks and pitfalls of hydrant flushing. Further, it is an object of the invention to provide a portable diffuser which allows flushing to take place in a safe manner without destroying surrounding landscaping.

In one embodiment, the invention includes a hydrant flushing diffuser having a hood and a chute. The hood has a closed top and an open base and includes an aperture. The chute comprises a porous fabric bag that is open on one end, wherein the chute is connected to the hood so that the open end of the bag surrounds the aperture in the hood. Additionally, the invention may include a strap that wraps around the base of the hood whereby the hood may be secured around a hydrant. Further, the hood may comprise a second aperture in the top of the hood to allow access to a hydrant valve on the hydrant. Additional features may also be included with the diffuser.

DETAILED DESCRIPTION OF A PREFERRED EMBODIMENT

Figure 1:
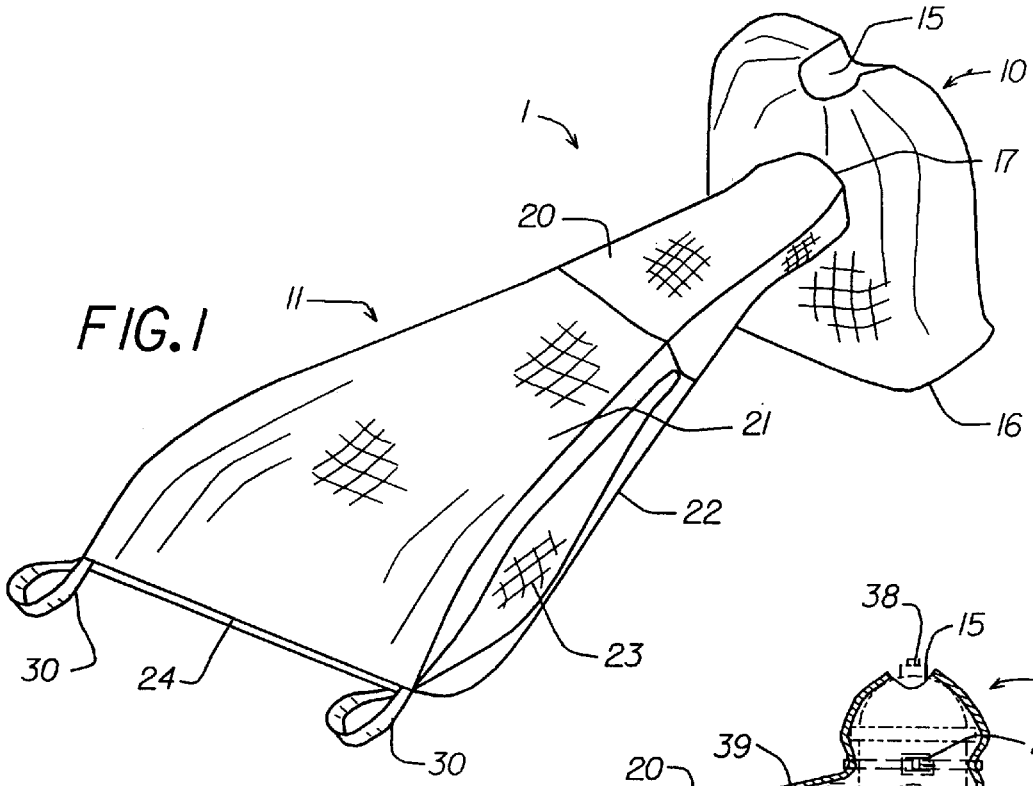
FIG. 1 is a perspective view of a preferred embodiment of the hydrant flushing diffuser.

Referring now to FIG. 1, the diffuser 1 includes an attached arrangement preferably in the form of a hood 10 that is a generally bell-shaped covering that is adapted to fit over a fire hydrant. The hood 10 is made of an impermeable fabric material. The bottom 16 of the hood 10 is open to allow the hood to be slipped over and then, after use, removed from a hydrant. The hood 10 also includes an access aperture 15. The access aperture 15 is adapted to allow a hydrant valve to protrude through the hood 10 so that water flow through a hydrant maybe controlled. Finally, the hood 10 includes a discharge aperture 17 on one side of the hood 10. The discharge aperture is adapted to be positioned adjacent the spout of a fire hydrant. The discharge aperture is typically six inches in diameter. Obviously, the size and shape of the aperture may vary depending on the size of a hydrant spout. Also, the location of the discharge aperture may be moved in different embodiments based on the location of the spout in a given type of hydrant.

In a preferred embodiment, the hood 10 is made of an impermeable laminated fabric. The laminent includes a woven polypropylene that is lined on the inside with a 60 mil PVC, fiber reinforced liner. The woven polypropylene is commercially referred to as AMOCO 2044 fabric.

Alternatively, no hood is necessary at all. Straps or other attaching arrangements can anchor the bag to the hydrant so that the open end of the bay is aligned with the hydrant spout.

Connected to the hood 10 is the chute 11. The chute 11 is connected to the hood 10 around the discharge aperture 17. In this way, when the hood 10 is mounted over a hydrant, water that is discharged from the hydrant spout will spray into the chute 11. The discharge aperture 17 where the chute 11 is connected to the hood 10 is the narrowest portion of the chute. The further away from the hood 10, the wider is the chute 11. The chute 11 includes a first portion 20 that is the narrowest portion of the chute. This portion 20 is connected to the hood 10 at the discharge aperture. This portion 20 of the chute 11 is made of an impermeable laminate fabric. In a preferred embodiment, this first portion 20 is made of the same woven polypropylene/PVC laminate as the hood 10 described above. This first portion 20 channels the water flow to the remaining portion of the chute 11. In a preferred embodiment, the chute 11 is approximately 12 feet long. That is, the distance from the discharge aperture 17 to the closed end 24 of the chute 11 is 12 feet. The first portion 20 is shown as approximately 3 feet of the entire length. The width of the closed end 24 of the chute 11 is six feet. The chute 11 is further comprised of a top panel 21, bottom panel 22, and side panels 23. The top panel is connected on one end to the first portion 20 and on the opposite end to the bottom panel 22. The top panel 21 is connected along the sides to the side panels 23. The bottom panel 22 of the chute 11 is made of an impermeable fabric laminate. Preferably, this laminate is the same woven polypropylene/PVC laminate as the hood 10 as described earlier. The top panel 21 and side panels 23 are porous to allow water discharged from the spout to exit from the chute 11. In a preferred embodiment, the top panel 21 is made of the woven polypropylene material, one commercial embodiment of which is AMOCO 2016 fabric. This is a heavy-duty woven polypropylene that can withstand the pressures necessary in this application. The side panels 23 are also made of porous woven fabric. In a preferred embodiment, this fabric is Synthetic and Erosion 10 fabric. This is a monofilament polypropylene material. Obviously, other types of porous fabrics may be used to make up all or portions of the chute 11. The specific reference to fabrics and laminated fabrics in this application have been found to be suitable for use. Any fabric that can handle the substantial water flow from a fire hydrant will be suitable.

At the closed distal end 24 of the chute 11, stablizing loops 30 are permanently attached. The loops 30 allow for easy handling and installation of the diffuser appartus. The loops 30 may be sewn into the closed end 24. Alternatively, they can be riveted or otherwise permanently attached at the closed end.

Figure 2:
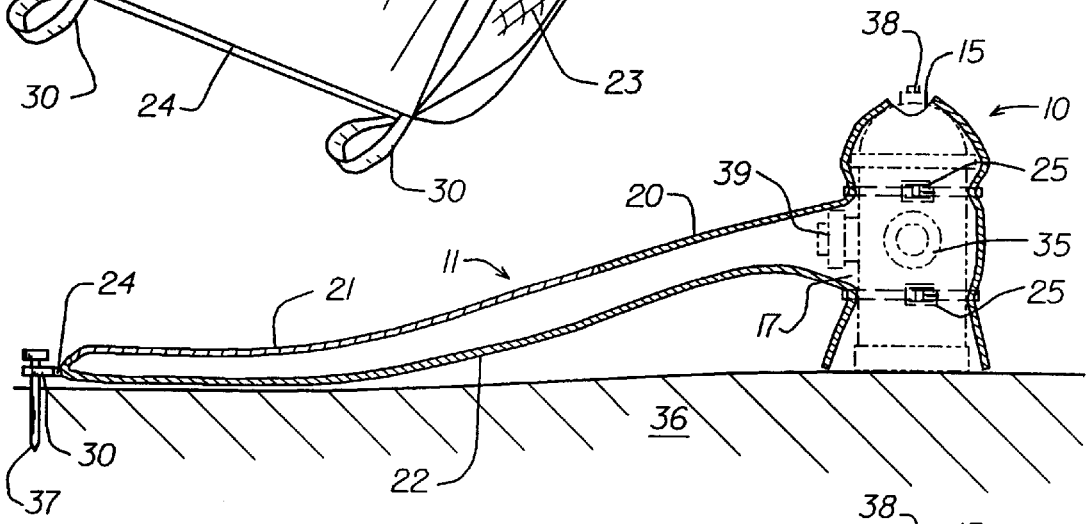
FIG. 2 is a side elevation cross-sectional view of one embodiment of the diffuser mounted about a fire hydrant shown in dotted lines.

Referring now to the FIG. 2, a conventional hydrant 35 is shown in broken lines. The hydrant 35 includes a spout 39 and a hydrant valve 38. As shown, the hood 10 slides over the hydrant 35 so that the access aperture 15 allows access to the hydrant valve 38. Further, the spout 39 is aligned with the discharge aperture 17. There are also shown straps 25 which may be tightened or losened to secure the hood 10 around the hydrant 35. In this way, the water flow from the spout 39 can not accidentally pull the hood 10 off of the hydrant 35. The chute 11 includes the first portion 20, the bottom panel 22 and the top panel 21. As discussed earlier, the top panel 21 is made of a porous fabric. The bottom panel 22 and the first portion 20 are made of an impermeable fabric laminate. The stabilizing loops 30 are shown secured or anchored to the ground 36 by at least one and preferably a pair of stakes 37. In this way, the chute is maintained in place when water is being discharged from the hydrant 35.

Figure 3:
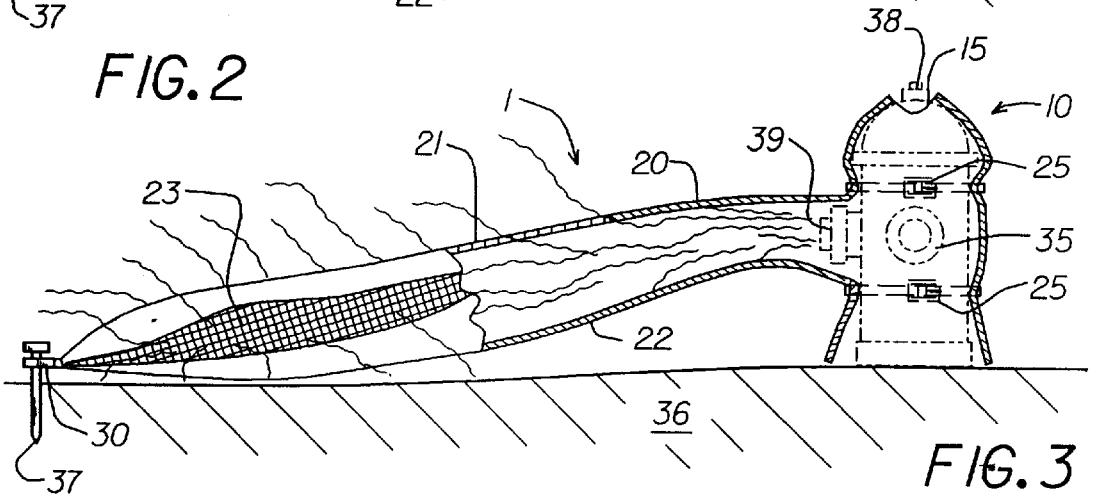
FIG. 3 is a side elevational, partial cross-sectional view of a diffuser in accordance with the present invention demonstrating the flow of water out of the hydrant and diffused through the chute.

FIG. 3 likewise shows a side view of the hydrant 35 with the diffuser 1 mounted around it. FIG. 3 is the same as FIG. 2 except there is shown the flow of water out of the spout 39. When this happens, the water flows upwardly through the top panel 21 and out the side panels 23.

A chute similar to chute 11 may be made of any type of collection of panels depending on the preference of a designer. For instance, in this preferred embodiment, the water flow is directed upwardly and through the sides of the chute. In this way, the ground underneath the chute will not be damaged by rapid water flow. In certain applications, however, the water flow may be desired to be guided in a specific direction. Obviously, other types or layers of fabrics may be included that may be moved around the chute to seal off sections of the chute and open others. For instance, snaps or velcro may be used seal one side of a chute so that the water will only diffuse out the opposite side. Any number of variations are possible.

The preferred embodiment described herein is a commercially available product that is marketed under the name Royal Flush™. The specific fabrics identified in this application are the types of fabrics incorporated in the commercial embodiment of the Royal Flush™ diffuser. The Royal Flush™ diffuser has been found to be effective with a water flow up to 3300 gallons per minute. Hydrants which emit a lower water flow may only require a smaller diffuser, that is one with a smaller chute than that described herein. The opposite is also true—higher volume hydrants may require larger diffusers to sufficiently handle the water flow from a hydrant.

Numerous characteristics and advantages of the invention have been set forth in the foregoing description. It will be understood, of course, that this disclosure is, in many respects, only illustrative. Changes can be made in details, particularly in matters of shape, size, in arrangement of parts without exceeding the scope of the invention. The invention's scope is defined by the language in which the appended claims are expressed.

That which is claimed is:

1. A hydrant flushing diffuser comprising a hood and a chute, the hood having a closed top and open base and comprising an aperture, the chute comprising a porous fabric bag that is open on one end, wherein the chute is connected to the hood so that the open end of the bag surrounds the aperture in the hood.

2. A hydrant flushing diffuser as described in claim 1 wherein the hood further comprises a strap around the base of the hood whereby the hood may be secured around a hydrant.

3. A hydrant flushing diffuser as described in claim 1 wherein the hood is comprised of impermeable fabric.

4. A hydrant flushing diffuser as described in claim 1 wherein the hood comprises a second aperture in the top of the hood to allow access to a hydrant valve on the hydrant.

5. A hydrant flushing diffuser as described in claim 1 wherein the fabric bag further comprises a plurality of fabric panels connected along the edges of each panel to form the bag.

6. A hydrant flushing diffuser as described in claim 5 wherein fabric panels comprise a top panel and a bottom panel, the bottom panel being the bottom portion of the bag that rests on the ground next to the hydrant.

7. A hydrant flushing diffuser as described in claim 6 wherein the bottom panel is comprised of impermeable fabric.

8. A hydrant flushing diffuser as described in claim 6 wherein the fabric panels further comprise side panels made from permeable fabric.

9. A hydrant flushing diffuser as described in claim 1 wherein the fabric bag further comprises stabilizing loops connected to the closed end of the bag.

10. A hydrant flushing diffuser comprising:

a attaching arrangement adapted to secure the diffuser to a hydrant, and a chute comprising a porous bag secured to the attaching arrangement for alignment with a spout on the hydrant, whereby water streaming from the spout is diffused by the porous bag before impacting the ground.

11. The diffuser as described in claim 10 wherein the chute has a distal end with anchoring attachments for cooperation with at least one ground stake to stabilizing the chute as water passes there through.

12. A hydrant flushing diffuser as described in claim 10 wherein the fabric bag further comprises a plurality of fabric panels connected along the edges of each panel to form the bag.

13. A hydrant flushing diffuser as described in claim 12, wherein fabric panels comprise a top panel and a bottom panel, the bottom panel being the bottom portion of the bag that rests on the ground next to the hydrant.

14. A hydrant flushing diffuser as described in claim 13, wherein the bottom panel is comprised of impermeable fabric.

15. A hydrant flushing diffuser as described in claim 13, wherein the fabric panels further comprise side panels made from permeable fabric.

* * * * *